United States Patent [19]

Jukes et al.

[11] 4,131,690

[45] Dec. 26, 1978

[54] METHOD OF POWDER COATING AN INSULATED ELECTRICAL CONDUCTOR

[75] Inventors: John A. Jukes, Pierre Fonds; Philip A. McGettigan, Montreal, both of Canada

[73] Assignee: Northern Electric Company Limited, Montreal, Canada

[21] Appl. No.: 574,608

[22] Filed: May 5, 1975

[51] Int. Cl.[2] ..... B05D 5/00; B05D 5/12

[52] U.S. Cl. ..... 427/32; 174/120 R; 174/120 C; 174/120 SR; 174/121 R; 174/121 A; 174/121 SR; 427/27; 427/118; 427/119; 427/120; 427/195; 427/379; 427/409

[58] Field of Search ..... 427/27, 32, 185, 195, 427/117, 118, 120, 379, 380, 119, 409; 174/120 R, 120 C, 120 SR, 121 R, 121 A, 121 SR, 121 B

[56] References Cited

U.S. PATENT DOCUMENTS

| | | | |
|---|---|---|---|
| 2,316,572 | 4/1943 | Eaton | 427/118 |
| 2,631,186 | 3/1953 | Bondon | 174/121 SR X |
| 2,789,926 | 4/1957 | Finholt et al. | 427/23 X |
| 2,933,457 | 4/1960 | Steinberg | 174/120 R X |
| 3,019,126 | 1/1962 | Bartholomew | 427/32 X |
| 3,090,696 | 5/1963 | Gemmer | 427/185 |
| 3,183,113 | 5/1965 | Gemmer | 427/185 |
| 3,396,699 | 8/1968 | Beebe et al. | 427/27 X |
| 3,546,017 | 12/1970 | Pendleton et al. | 427/32 X |
| 3,560,239 | 2/1971 | Facer et al. | 427/185 X |
| 3,772,455 | 11/1973 | Nicodemus et al. | 174/121 SR X |
| 3,781,462 | 12/1973 | Santos et al. | 174/120 R X |
| 3,917,901 | 11/1975 | Jones | 174/120 R X |

FOREIGN PATENT DOCUMENTS

| | | | |
|---|---|---|---|
| 675205 | 12/1963 | Canada | 427/374 C |

*Primary Examiner*—Shrive P. Beck

*Attorney, Agent, or Firm*—Shlesinger, Arkwright, Garvey & Dinsmore

[57] ABSTRACT

A method of producing an insulated electrical conductor, in which a wire conductor is coated with an inner layer of heat resistant material and covered with electrostatically deposited powdered polymeric material which is fused by heat to form an outer layer of insulation. An insulated electrical conductor produced by this method comprises a core carrying an inner coating of heat resistant material and an outer coating of fused polymeric material.

11 Claims, 6 Drawing Figures

A
B
C
3
3

METHOD OF POWDER COATING AN INSULATED ELECTRICAL CONDUCTOR

This invention relates to an insulated wire conductor and to its manufacture.

Because of the growth of telephone subscribers in metropolitan centres the main distributing frames in telephone switching centres are becoming congested and expansion is limited. This problem could be alleviated if, together with redesigning the frame, communications wires used in the frame could be reduced in diameter. However, smaller diameter insulated wire conductors presently available do not have the necessary physical and electrical requirements which include connecting characteristics for wire wrapped, soldered and quick clip connections, good longitudinal strength, a low coefficient of surface friction, low springiness, good stripability, low flammability combined with low toxic gas emission, good resistance to abrasion and cutting, and heat resistance when contacted by soldering irons.

It is an object of the invention to provide an improved method of manufacturing a small diameter insulated wire conductor using electrostatic deposition of a polymeric material.

It is another object of the present invention to provide an insulated wire conductor of small diameter suitable for use in distribution frames of telephone switching centres.

In its broadest aspect the invention consists of a method of producing an insulated conductor of small diameter, comprising the steps of electrostatically depositing powdered polymeric material on the wire conductor coated with a layer of electrically insulating heat resistant fibrous material, applying heat externally to the conductor to fuse the polymeric material to form an outer layer of insulation, and cooling the polymer coated conductor. Preferably the resistant fibrous insulating material is wood pulp and the polymeric material is nylon. Preferably, also, the method includes the step of coating the wire conductor with the fibrous material.

Example embodiments of the invention are shown in the accompanying drawings in which.

Figures 1, 2, 3:
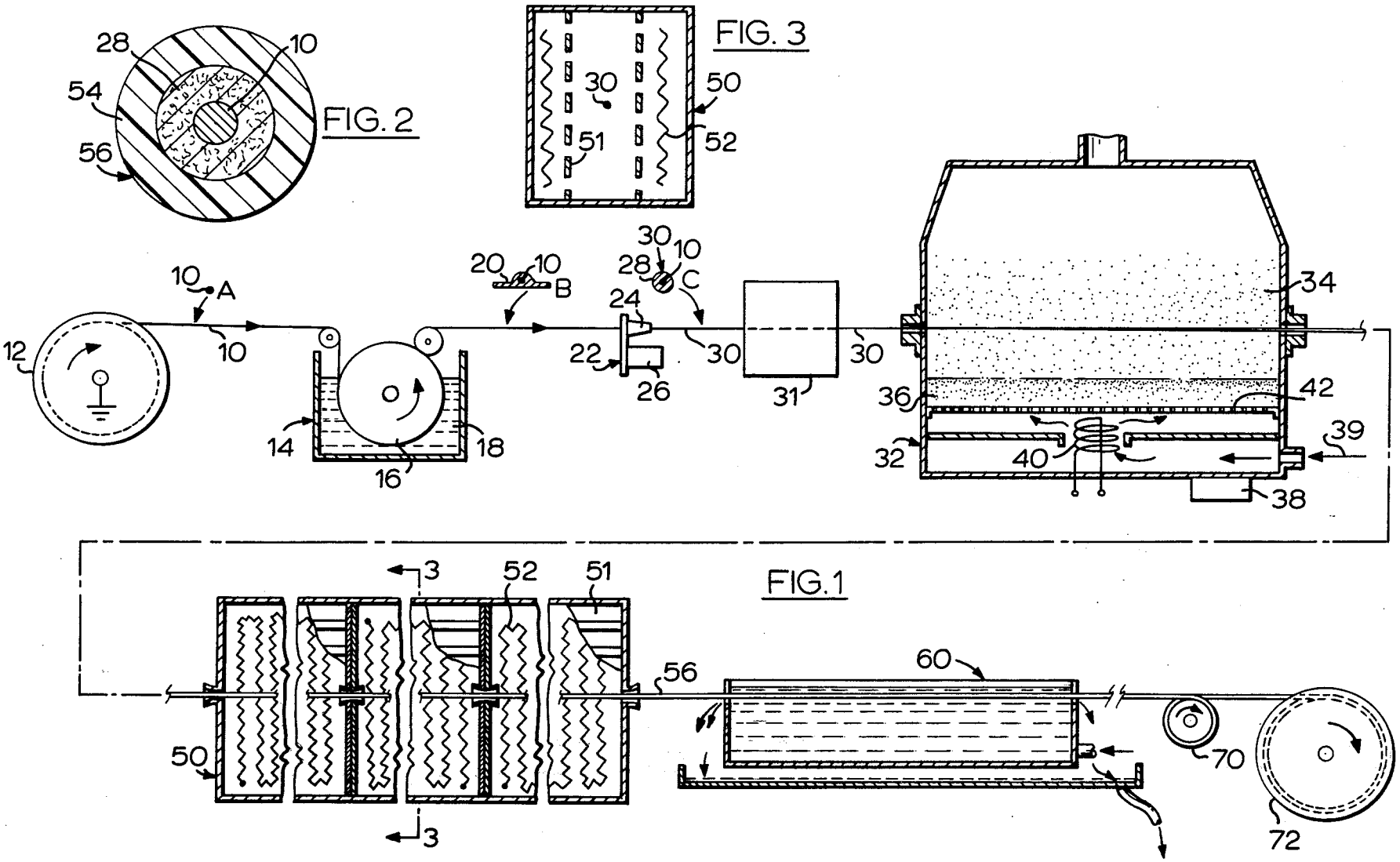
FIG. 1 is a schematic flow diagram of a method of forming an insulated conductor.
FIG. 2 is a cross-sectional view of an insulated conductor produced according to the steps of the method shown in FIG. 1.
FIG. 3 is a cross-sectional view taken along line 3—3 of FIG. 1.

In the schematic flow diagram of FIG. 1 a continuous strand of bare electrically conductive wire 10 as shown in cross-section A is unwound from a give-up or supply reel 12 into a pulp vat 14 where it passes around a cylinder mould 16 partially submerged in pulp liquid 18. Wire 10 emerges from vat 14 embedded in a strip coating 20 of pulp insulation as shown in cross-section B. Coated wire 10 passes through a polisher 22 between elements or shoes 24 axially rotated by a motor 26 which folds the laterial portions of strip coating 20 around the wire to form an annular sheath or layer of insulation 28 producing a pulp-insulated wire strand 30 as shown in cross-section C.

From polisher 22 the pulp-insulated wire 30 passes longitudinally through a drying oven 31 and into an electrostatic chamber 32 where it travels continuously through a cloud of electrically charged particles 34 of polymeric material. Wire 10 is grounded through supply reel 12 and attracts particles 34 which electrostatically adhere to insulation 28 of strand 30. Electrostatic chamber 32 provides a fluidized bed 36 of particles 34 which is agitated by a vibrator 38. Particles 34 are lifted by an air stream indicated by arrow 39 which is ionized by passing over a direct current electrode 40 using high voltage maintained at a suitable potential and then through a porous plate 42 below fluidized bed 36. An electrostatic chamber 32 suitable for the purpose is supplied by Electrostatic Equipment Corporation of New Haven, U.S.A., Model 400B.

The thickness of the coating of charged particles 34 adhering to strand 30 is governed by a number of parameters including the direct current potential of charging electrode 40, the speed of strand 30 travelling through chamber 32, the length of the chamber, the location of the strand in relation to fluidized bed 36, and the character of the particles themselves, for example the size of the particles and the dielectric constant of the material used. Pulp insulation 28 on strand 30 does not prevent attraction of particles 34 onto the strand but the thickness of the insulation influences the build-up of particles and causes the particles to build more heavily where the insulation is thinner, thus tending to make the diameter of the outer surface of the strand more uniform. The resultant shallow undulations actually reduce the coefficient of friction over a corresponding flat surface or a more deeply undulated surface. Moreover, as particles 34 build up on strand 30 they develop a larger repulsive force against the adherence of additional particles, which causes the build-up of particles to be self-limiting. Besides the thickness of insulation 28, its moisture content and density affects its dielectric constant which is an additional parameter governing the build-up of particles 34 on strand 30. Example polymeric materials suitable for use in the present invention are nylon, polypropylene, polyurethane, and HALAR which is a trade mark of Allied Chemical Corporation used in association with ethylene-chlorotrifluoroethylene.

When strand 30 with adhering particles 34 emerges from electrostatic chamber 32 the strand enters a heating oven 50 where it travels continuously between a pair of baffles 51 which are mounted in front of heat radiating elements 52 to fuse the particles of polymeric material and to cure the fused particles, thus producing a second layer of insulation 54 forming a wire conductor 56 as shown in FIG. 2. As seen in FIG. 1, heating oven 50 is in three stages. The design of oven 50 is governed by the particular polymeric material forming particles 34, the speed of travel of strand 30 and the length of the oven. The heating process must be such that particles 34 are completely fused one with another to form a smooth surface and to eliminate any pinholes and bubbles of trapped air but not rendered of such viscosity as to allow the polymeric material to flow downwardly and to form an oval layer or droplets or to degrade the polymer.

When wire conductor 56 emerges from oven 50 the conductor passes through a cooling bath 60 where it is quenched. The rate of cooling of the polymeric material may affect the quality of layer 54; for instance in the case of nylon rapid cooling produces smaller crystals which makes layer 54 more flexible while slower cooling produces larger crystals which makes layer 54 more abrasion resistant.

After passing through cooling bath 60 the completed wire conductor 56 is passed over a capstan 70 and wound onto a take-up reel 72 for shipment.

Here it should be noted that attempts to extrude polymeric material such as nylon over heat insulating material such as pulp are unsatisfactory because of the difficulty in obtaining a thin, pinhole free and uniform coating of the polymeric material.

While wood pulp is preferably used to form heat insulating layer 28, other suitable materials such as paper may be used.

In a specific example of the production of an insulated conductor according to the invention, copper wire was coated with an inner layer of wood pulp and an outer layer of nylon to form conductor 56. Wire 10 of 22 Gauge tinned copper having 25% minimum elongation and an average diameter of 0.0253" was fed from reel 12 through vat 14 of wood pulp and through polisher 22 to apply a layer 28 having a thickness of about 0.0045", thus giving strand 30 an outer diameter of 0.034". Next, strand 30 was passed through electrostatic chamber 32, specifically Model 400B supplied by Electrostatic Equipment Corporation mentioned above, which was charged with clear nylon powder having an average particle size in the range of 60–80 microns with a maximum size of 100 microns. Such a powder is sold by Chemische Werke Huls A.G. under the designation HULS nylon 12 powder X1891. A powder level of 1–1½ inches stationary was maintained and strand 30 was moved approximately 60 feet per minute about 1 inch above, and parallel to, the powder level. A flow of dry air at 0.5 pounds per square inch was passed into the fluidized bed of nylon powder after being charged at 40 Kv while the unit was vibrated at 50 percent of maximum. After emerging from chamber 32, strand 30 was passed through oven 50 having a length of about 15 feet and divided into three equal stages with calrod heating elements 52 providing temperatures of 600° F., 500° F. and 500° F. successively. On emergance from oven 50, conductor 56 was passed into cooling bath 60 spaced about 15 inches from the oven exit and comprising a trough about 15 inches long with water flowing at a temperature of approximately 35° F. The final outer diameter of conductor 56 was 0.043".

Figure 4:
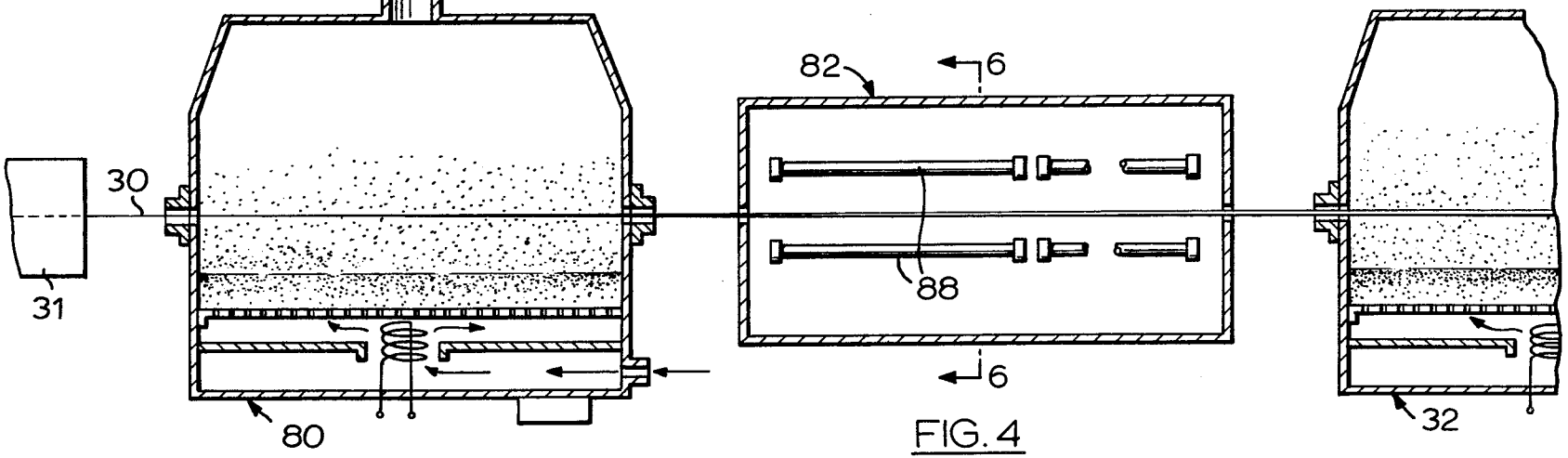
FIG. 4 is a partial schematic flow diagram similar to FIG. 1 but including additional steps in that method.
Figure 6:
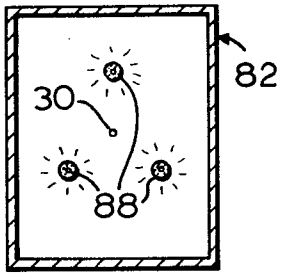
FIG. 6 is a cross-sectional view taken along line 6—6 of FIG. 5.
Figure 5:
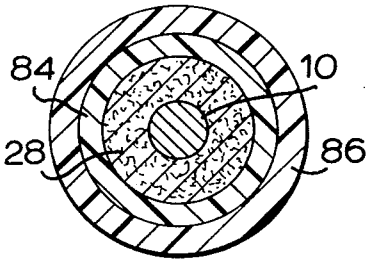
FIG. 5 is a cross-sectional view of an insulated conductor produced according to the steps of the method shown in FIG. 4.

It is preferable to make a conductor which is flame retardant and this can be accomplished by blending a suitable flame retardant in granular form with the particles of polymeric material. The granular form must be such that it is of the correct particle size and density to mix properly with the polymeric powder. However, to produce such a flame retardant conductor it is necessary to apply two layers of polymeric material in order to achieve the required properties of elongation and abrasion resistance. The properties of the flame retardancy are controlled by the thickness and composition of the inner layer of polymeric material while the properties of elongation and abrasion resistance are controlled by the thickness and the thermal treatment of the outer layer of polymeric material. As shown in FIGS. 4 to 6 of the drawings, an additional electrostatic chamber 80 and an additional heating oven 82 are located in the production line of FIG. 1, between oven 31 and electrostatic chamber 32. As pulp insulated wire strand 30 emerges from oven 31 it passes through electrostatic chamber 80 of the same type as chamber 52, which is charged with a powdered flame retardant blended with a powdered polymeric material. On emerging from chamber 80, strand 30 then passes into oven 82 which fuses the layer of adhering particles to form an intermediate layer 84 of flame retardant polymeric material as seen in FIG. 5. As seen in FIG. 6, oven 82 may carry quartz heating elements 88. The strand passes from oven 82 into electrostatic chamber 32 and then proceeds as described with reference to FIG. 1, forming an outer layer 86 of polymeric material as seen in FIG. 5, with the flame retardant diffusing somewhat from intermediate layer 84 into outer layer 86.

In a specific example of the production of a flame retardant conductor a pulp-insulated wire strand 30 was first electrostatically coated with a dry blended particulate mix of 12% by weight FR-300-BA (a trade mark of Dow Chemical Company applied to decabromo diphenyl oxide), 6% by weight antimony oxide, 0.4% by weight pigment, and 81.6% by weight nylon, applied to approximately 2 mils thickness. After the first coating was fused by passing it through oven 82 a second coating of clear nylon was electrostatically applied to approximately 2.5 mils thickness, which was fused by passing the strand through oven 50.

Since commercial flame retardants are usually white powder it would be necessary to use pigmented polymeric material if a specifically coloured conductor 56 is required, because a coloured insulating layer 28 would not show through the outer composite layer.

It will be appreciated that the application of inner layer 28 of heating insulating material does not have to be carried out in tandem with the electrostatic application of outer layer 54 of polymeric material, and strand 30 may be stored on a take-up reel for later use in carrying out the method of the invention.

The polymeric material used in the invention may be a pure polymer or a polymer with a suitable additive or additives.

I claim:

1. A method of producing an insulated electrical conductor comprising the steps of:

electrostatically depositing a powdered polymeric material onto a wire conductor coated with an annular sheath of electrically insulating heat resistant fibrous material.

applying heat externally to the conductor to fuse the polymeric material to form an uniform outer layer of polymeric material and cooling the polymer coated conductor.

2. A method as claimed in claim 1 including the step of coating the wire conductor with said fibrous material.

3. A method as claimed in claim 1 in which the polymeric material is nylon.

4. A method as claimed in claim 1 in which the fibrous material is wood pulp.

5. A method as claimed in claim 1 in which the heat is applied to the conductor in a plurality of stages of successively lower temperatures.

6. A method as claimed in claim 5 in which the polymeric material is nylon and the successive temperatures are 600° F. and 500° F.

7. A method as claimed in claim 1 in which the conductor is cooled by quenching.

8. A method as claimed in claim 7 in which the conductor is quenched in water having a temperature in the range of 33 to 37° F.

9. A method as claimed in claim 1 including the preliminary step of electrostatically depositing a mixture of powdered flame retardant material and powdered polymeric material on the wire conductor coated with a layer of electrically insulating heat resistant fibrous material, and applying heat externally to the conductor to fuse the mixture to form an intermediate layer of insulation.

10. A method as claimed in claim 9 in which the mixture of polymeric material and flame retardant material is 12% by weight decabromo diphenyl oxide, 6% by weight antimony oxide, and 81.6% by weight nylon, and 0.4% by weight pigment.

11. A method as claimed in claim 1 in which the polymeric material is powdered nylon having a particle size in the range of 60–100 microns.

* * * * *